United States Patent [19]

Warwick

[11] Patent Number: 5,046,481

[45] Date of Patent: Sep. 10, 1991

[54] HEATING APPARATUS

[76] Inventor: Dean M. Warwick, North Trinity, Bowmont Street, Kelso, Roxburghshire TD5 7JH, Great Britain

[21] Appl. No.: 359,658

[22] PCT Filed: Nov. 27, 1987

[86] PCT No.: PCT/GB87/00851

§ 371 Date: Jul. 27, 1989

§ 102(e) Date: Jul. 27, 1989

[87] PCT Pub. No.: WO88/04014

PCT Pub. Date: Jun. 2, 1988

[30] Foreign Application Priority Data

Nov. 28, 1986 [GB] United Kingdom ..... 8628563

[51] Int. Cl.[5] ..... F24B 1/189

[52] U.S. Cl. ..... 126/522; 126/523; 165/146; 165/903; 237/55

[58] Field of Search ..... 126/522, 523, 524, 525, 126/307 R; 165/903, 146, 901; 237/52-55; 34/86

[56] References Cited

U.S. PATENT DOCUMENTS

| | | | |
|---|---|---|---|
| 1,334,741 | 3/1920 | Dundon | 126/104 R |
| 1,627,265 | 5/1927 | Bancel | 165/146 |
| 2,613,065 | 10/1952 | Didier | 165/146 |
| 2,882,023 | 4/1959 | Rizzo | 165/901 |
| 3,905,351 | 9/1975 | Hatfield | 126/522 |
| 4,550,772 | 11/1985 | Knoch | 165/901 |
| 4,805,692 | 2/1989 | Palmer et al. | 165/903 |

FOREIGN PATENT DOCUMENTS

| | | | |
|---|---|---|---|
| 2342787 | 3/1975 | Fed. Rep. of Germany | 165/146 |
| 808092 | 1/1937 | France | 165/146 |
| 920812 | 4/1947 | France . | |
| 929047 | 12/1947 | France . | |
| 1328762 | 4/1963 | France . | |
| 109647 | 8/1979 | Japan | 165/134.1 |
| 606773 | 8/1948 | United Kingdom | 165/903 |
| 758247 | 10/1956 | United Kingdom . | |

*Primary Examiner*—James C. Yeung

*Attorney, Agent, or Firm*—Fleit, Jacobson, Cohn, Price, Holman & Stern

[57] ABSTRACT

Heating apparatus for heating an environment comprises one or more heat exchange conduits (A, B, C, D, E, F, 6, 8) located in the flow path of primary heated fluid (F1–F2), and a device (4) for inducing a flow of air in each conduit, each conduit being adapted to carry air into, through and out of a heat flow path to the environment (2), the arrangement being such that, in use, air within the conduits progresses from a cooler to a hotter part of the heat flow path, and the conduits are spaced closer together toward the downstream direction of the flow path to improve the efficiency of heat exchange between the primary heated fluid and secondary air in the conduits.

16 Claims, 5 Drawing Sheets

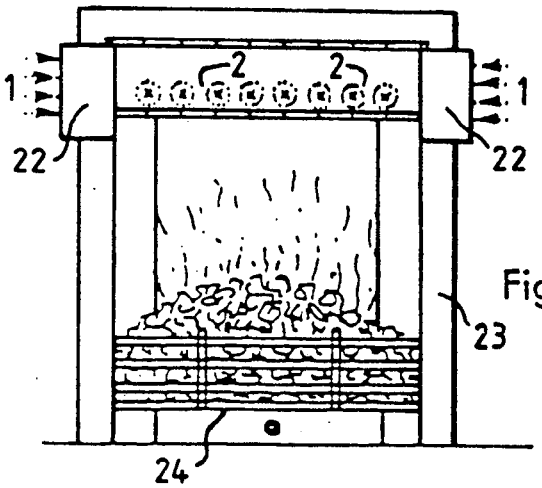
Figure 1
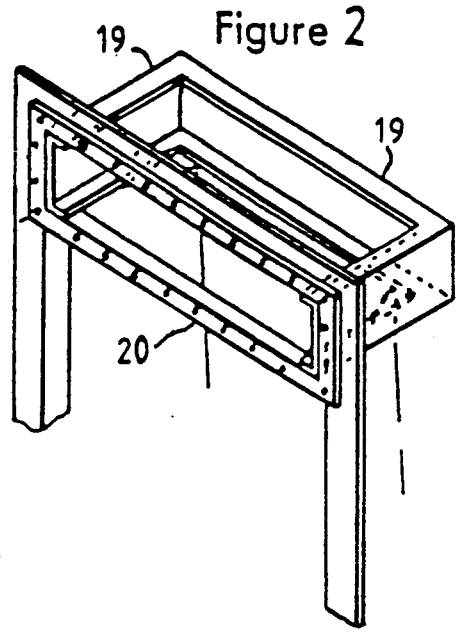
Figure 2
Figure 3
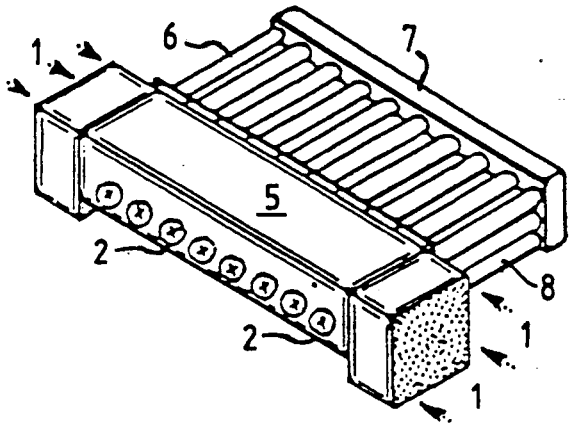
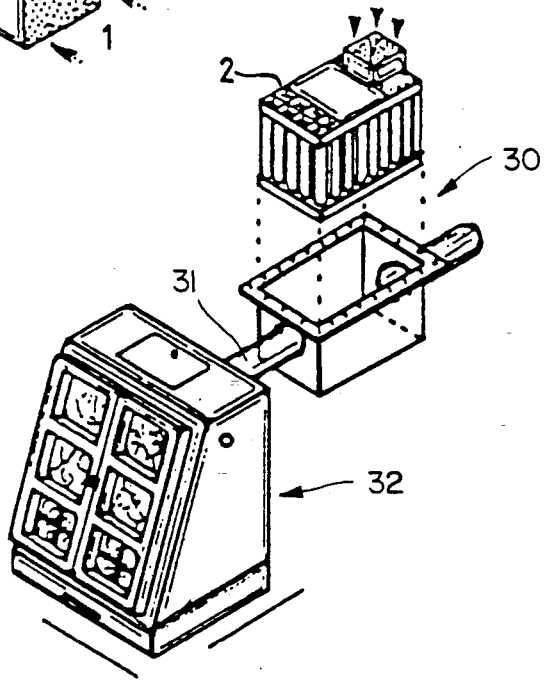
Figure 4

Figure 10
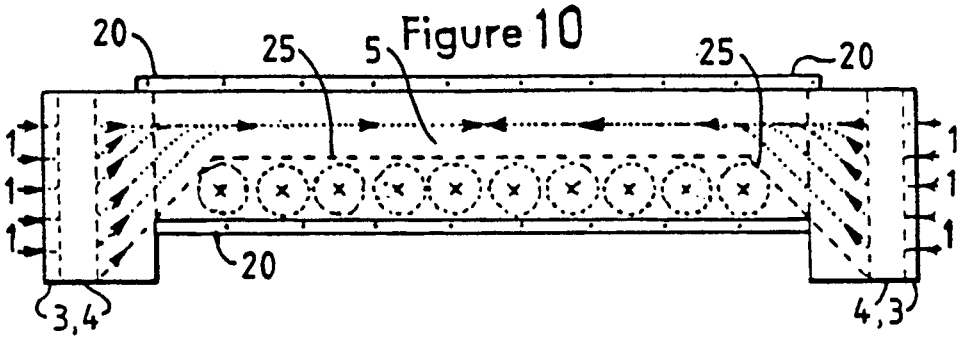
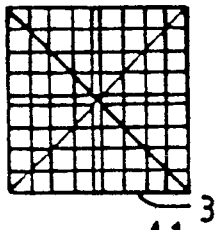
Figure 11
Figure 12
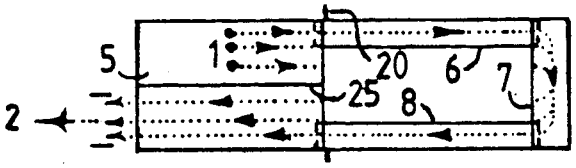
Figure 13
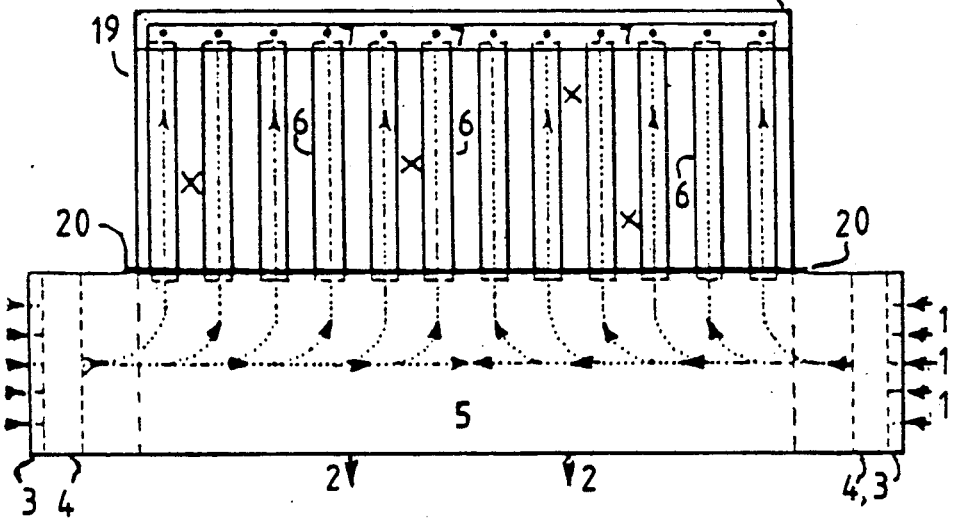
Figure 14
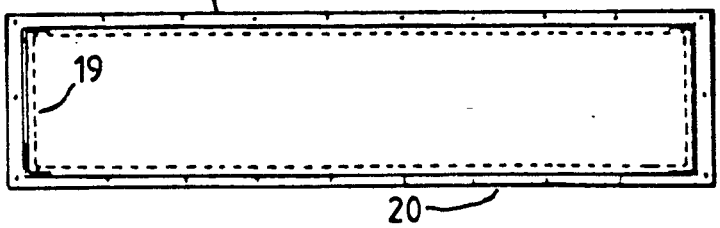
Figure 15
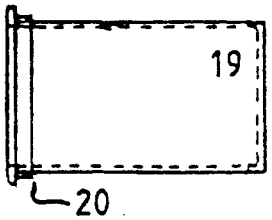

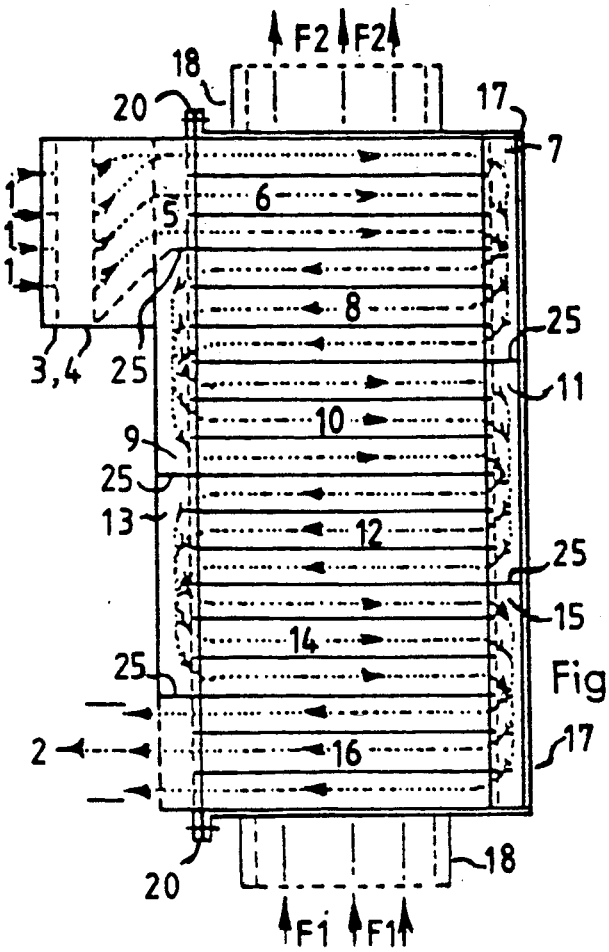
Figure 19
Figure 20
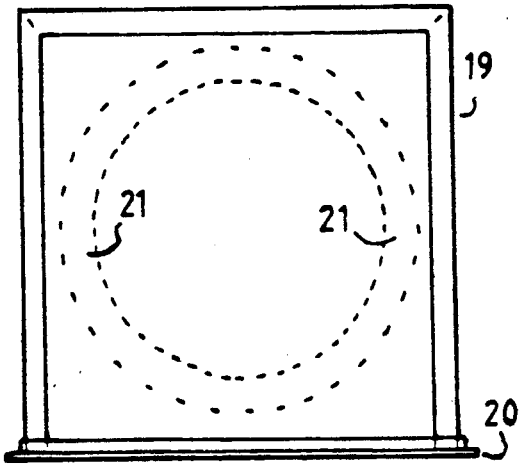

HEATING APPARATUS

BACKGROUND OF THE INVENTION

This invention relates to heating apparatus, particularly of the type which makes use of heat from existing heating or cooking apparatus.

Open fires, closed fires, boilers, cookers (solid fuel, oil or gas), ceiling mounted radiant gas heaters and etc, loose valuable heat to the outside atmosphere without the benefit of all the heat generated having contributed to the inside atmosphere of the home or workplace.

Heat is transmitted by three means; Radiation, Convection and Conduction. Most of the heat transmitted to the room from an open fire is by radiation. No convected heat emits from an open fire—it cannot. All the convected heat and most of the conducted heat—which conducted heat in turn transfers to convected heat in the main as air passing over the fire surrounds draws on that heat and takes it away up the flue—is lost up the flue and in turn to the outside atmosphere.

All fires—unless supplied with air for combustion in a sealed ducted source from the exterior—actually lower room temperature for some time after starting up. An open fire on an exterior wall is at best 10% efficient, on an interior wall is at best 20% efficient. A free standing closed solid fuel fire is at best 30% efficient. Solid fuel, oil or gas cookers are at best 53% efficient. Ceiling mounted radiant gas heaters are at the 30% efficient, and wall mounted radiant/convector gas heaters are at best 50% efficient. Solid fuel, oil or gas boilers are in the 50%-60% efficiency range with the most efficient being a very low output gas boiler in the region of 74% efficiency. These figures take into account all the heat generated which actually finds its way first to the interior including that which bleeds through the linings and structure of the flue to the interior. The remaining percentage is the heat energy which is lost to the outside atmosphere without benefit to the purpose for the heating system—this is the heat lost up the flue in the form of the convected heat generated in the system, and in turn a part of that convected heat which is converted to conducted heat and lost through the exterior lining and structure of the flue.

BRIEF SUMMARY OF THE INVENTION

An object of this invention is to provide heating apparatus which makes use of the otherwise wasted heat and returns it back to the interior of the area being heated.

According to the present invention, there is provided heating apparatus for heating an environment, comprising a passage defining a flowpath for warm gas, the flowpath being adapted to pass warm gas past a plurality of heat exchange tubes generally transverse to the flowpath and spaced therealong, the tubes forming at least in part at least one heat exchange conduit adapted to carry air through the flowpath from a downstream to an upstream part thereof in indirect heat exchange, and air-flow inducing means for inducing a flow of air in the or each conduit and thence to the environment, characterized in that the spacing between adjacent tubes progressively decreases in the downstream direction of the flowpath thereby in use progressively improving the rate of heat exchange between the air and the warm gas.

Preferably one or more heat exchange conduits comprises one or more first banks of parallel tubes extending into a heat flow path, the inlets of the tubes being operatively connected to air flow-inducing means, and one or more second banks of parallel tubes connected directly or indirectly to the outlets of the first tubes and extending out of the heat flow path.

Preferably, the one or more heat exchange conduits comprises a plurality of parallel tube elements which provide a sinuous flow path for air.

Preferably the or each heat exchange conduit is in the form of a continuous tube.

Heating apparatus according to the present invention comprises a plurality of banks of tubes for parallel spaced location in the path of a flow of heat, each bank being in intercommunication with the or each end adjacent bank by passage means and so disposed that the bank nearest the heat source is upstream of the heat flow and the bank remote or remotest from the heat source is downstream of the or each other bank, and air flow-inducing means for inducing a flow of air into the bank or banks of tubes at the downstream end of the heat flow, to pass the air through successive banks, provided to the upstream bank or banks nearest the heat source from which the air exits into a room or other enclosed area, the air as it enters the downstream bank or banks of tubes being relatively cool and being gradually heated as it passes through successive banks of tubes to exit at the upstream bank or banks of tubes at a higher temperature.

Preferably, where more than two banks of tubes are provided, the spacing between adjacent banks decreases towards the downstream bank.

Preferably the banks of tubes are formed as a unit and are located in a containment member mounted, in the warm gas flow path.

Preferably the air inlet or inlets to the or the most, downstream bank, or banks of tubes, is, or are, operatively connected to the air flow-inducing means, and the air outlet or outlets from the, or the most upstream, bank, or banks, of tubes communicate with a common room or other enclosed area whereby cool air is withdrawn therefrom into the banks of tubes and heated air is returned thereto.

Preferably the tubes in the banks downstream of the two most upstream banks progressively reduce in wall thickness from two upstream banks.

BRIEF DESCRIPTION OF THE DRAWINGS

Embodiments of the present invention will now be described in detail, by way of example, with reference to the accompanying drawings, wherein:

FIG. 1 is a front elevational view of a convector heating apparatus according to a first embodiment of the invention:

FIGS. 2 and 3 are perspective views of components of the apparatus shown in FIG. 1;

FIGS. 4, 5 and 6 are exploded perspective views of the apparatus according to a further embodiment.

FIG. 10 is a schematic elevation of a third embodiment of the invention:

FIG. 11 is an end elevation of FIG. 10;

FIG. 12 is a partial cross sectional view of FIG. 10 on a smaller scale;

FIG. 13 is a top plan view of FIG. 10:

FIG. 14 is a schematic elevational view of part of the apparatus shown in FIGS. 10 to 13;

FIG. 15 is a right end elevation of FIG. 14;

FIG. 19 is a schematic cross sectional view of a fifth embodiment of the invention; and FIG. 20 is a top plan view of a chimney breast for location therein of the apparatus of the fourth embodiment of FIG. 18;

DETAILED DESCRIPTION

Referring firstly to FIGS. 1 to 6, the room air flowing into the system to be heated is shown at 1 and the heated air returning is shown at 2. FIG. 1 is an open fire burning coal, wood, peat, gas (artificial logs or coal), and etc., with the unit of FIG. 3, fitted to the top of the open surround by a containment 19 and 20 shown in FIG. 2 as if a drawer in its slider to a cabinet.

FIG. 4 shows a unit 30 (in exploded view) fitted to the after flue pipe 31 of a closed fire 32.

Figure 5:
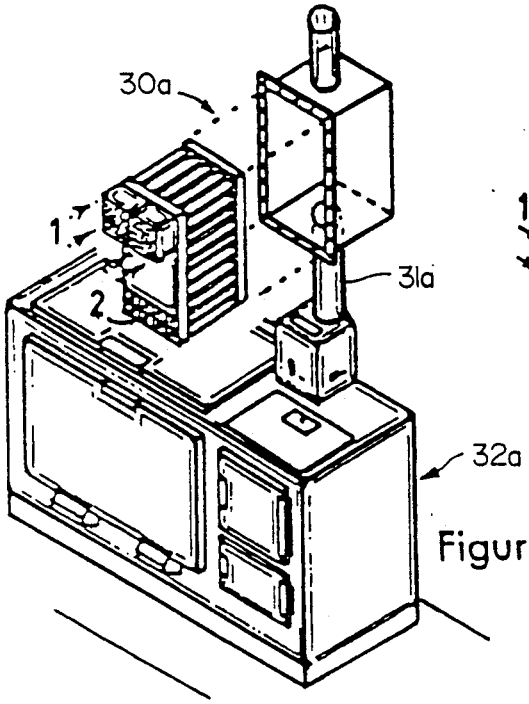

FIG. 5 shows a unit 30*a* fitted to the after flue pipe 31*a* of a solid fuel, oil or gas fired cooker/boiler 32*a*.

Figure 6:
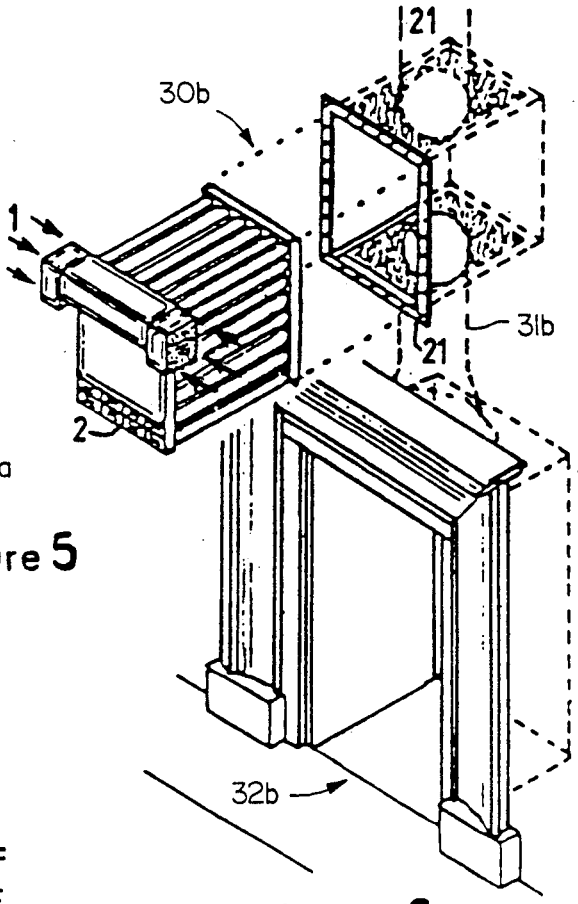

FIG. 6 shows a unit 30*b* fitted to the flue pipe 31*b* in the chimney breast above an open fire.

Other applications of the system are possible. A unit may be above a ceiling mounted radiant gas heater in a factory or warehouse. A unit may have the inlet 1 and the outlet 2 on the opposite sides of the wall to the heat source, e.g. as shown in FIG. 6, and the inlet 1 and the outlet 2 may be on opposite sides of the wall in each other, e.g. where emission is required in an adjoining room or hallway or into an adjacent cupboard for use as an airing cupboard. A unit may or may not have a supply of ducted fresh air from the exterior supplied to the inlet 1 and a unit may or may not have air from outlet 2 ducted away to some distant use. All applications of the system are dependant on the requirements of the user.

Figure 7:
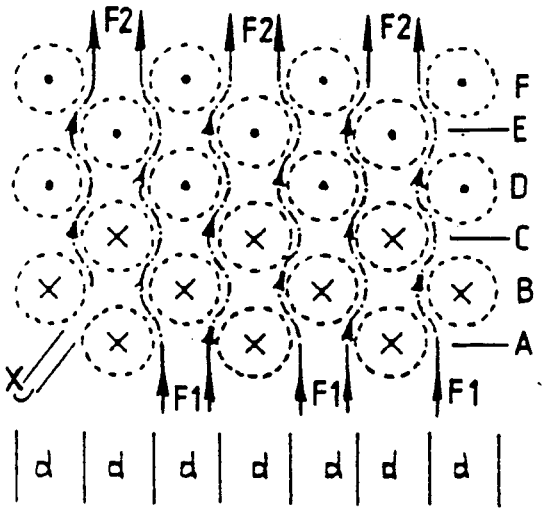
FIGS. 7, 8 and 9 are diagrammatic views showing the flow of heat from existing heating or cooking apparatus and the flow of air in the banks of tubes of the apparatus according to the invention.
Figure 8:
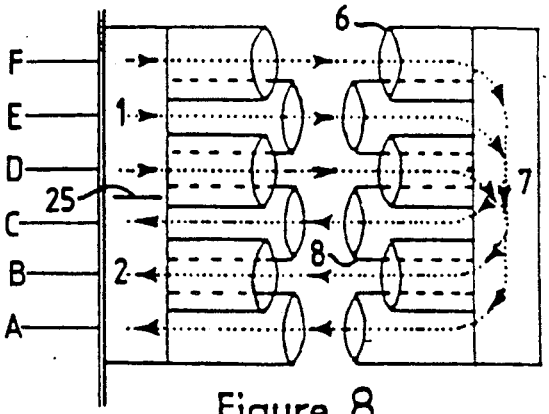

The working principles of the system are shown in FIG. 7 and FIG. 8 which show banks of tubes A, B, C, D, E, F, through which may be forced air from the room to be heated. The flow of the air through the unit is in the form of from the room 1 through the upper banks of tubes 6 down through the communicating chamber or header 7 and back through the lower banks of tubes 8 and return to the room 2. 25 is a seperating membrane. Flue gases from the heat source (fire etc.) rise up through the array of tubes at F1 and exit at F2. As the flue gases travel through the banks of tubes they heat up these tubes which in turn pass their heat on to the air passing through the tubes as shown in, FIG. 9.

The passage of air through the tubes is in overall effect in reverse order to that of the passage of the flue gases. Cool room air entering the system meets cooled flue gases leaving the system in the upper banks of tubes. This room air is gradually heated as it passes through the system, the reverse being the case for the flue gases, and meets the hotter flue gases entering the system in the lower banks of tubes as it—the room air—then leaves this harmonious system.

FIGS. 10, 11, 12, and 13 depict a unit in schematic elevation, end view, partial cross section and plan view, which unit may be fitted to the upper part of the opening to an open fire (as depicted in FIGS. 1 and 3) with the containment unit depicted in FIGS. 14 and 15 (as depicted in FIG. 2). Air is shown entering from the room 1 through a probable filter 3 and into the unit through the fan or fans 4, along a communication duct 5 and into the banks of tubes 6 (FIG. 12, only one tube shown for clarity) and into the communicating duct 7, or header, and down and back through the banks of tubes 8 (FIG. 12, only one tube shown for clarity) and exiting into the room 2.

Figure 9:
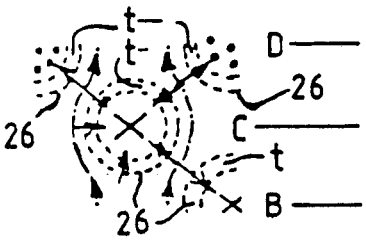

In the typical system with banks of tubes A, B, C, D, E, F, there may be a unit spacing horizontally between tubes of d for diameter, and a spacing between F and E which is less than the spacing between E and D which is less than the spacing between D and C which is less than the spacing between C and B which is less than the spacing between B and A. The net effect of this is that the spacing X between tubes from one bank to another and through which passes flue gases from F1 to F2, is gradually reduced as the flue gases approach the upper banks of tubes. The flue gases enter the system F1 and pass through the spacing X between banks B and A and heat is given up to the tubes contacted (FIG. 9). The flue gases—now reduced in temperature—travel on to spacing X between banks C and B which is smaller than that at B and A and which squeezes the flue gases and increases the flue gas pressure at this point, above that which it would have been had the flue gases met a spacing X between banks C and B the same as the spacing X between banks B and A. From gas law P·V/T is a constant and this increase in flue gas pressure has the effect of raising the flue gas temperature as it passes through spacing X, and by the raising of the flue gas temperature at that point effecting an increase in the heat exchange between the flue gases flowing round the tubes and the air flowing through the tubes. As the volume of flue gases remains a constant the flue velocity through spacing X is thereby increased. This process is repeated again and again through each spacing X at each juncture of banks of tubes until the flue gases leave the system F2 much reduced in temperature, and more so—reduced in temperature—than had the flue gases merely passed through a system with the spacings X a constant, and with this overall effective throat system having increased flue velocity to such an extent as to negate the possibility of back puff into the heat source.

The gauge thickness of the tube wall (FIG. 9) 26, in the two lower banks A and B are of equal gauge and of such thickness as to minimize their destruction from heat contact. The system may be further enhanced by the tubes in the upper banks above A and B being constructed of a gauge wall thickness lighter than that of tubes A and B and reducing in gauge wall thickness to the lightest being in the uppermost bank. This would have the effect of maximizing the rate of transfer of heat to the room air passing through the tubes which room air is quenching the inner wall of the tube of the heat conducted through the tube wall thickness. The net effect of this being maximum heat gain in the room air and maximum heat loss in the flue gases, i.e. maximum efficiency in the system.

A unit may comprise any number of tubes from two upwards depending on the system required for a particular application.

Figure 16:
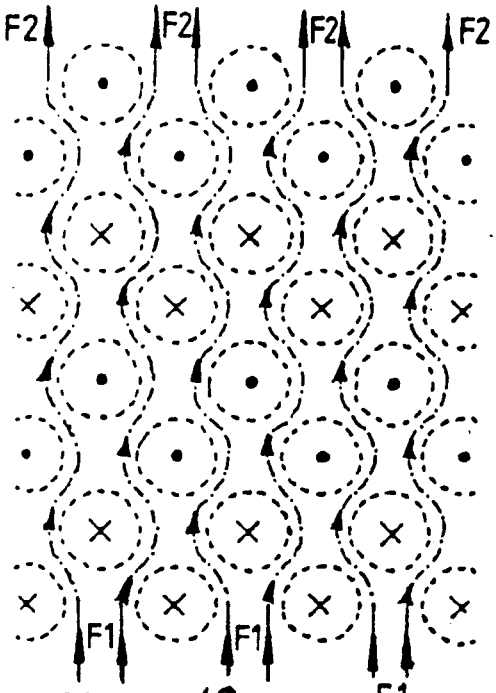
FIGS. 16 and 17 show further schematic illustrations of heat flow past the banks of tubes and air flow in the tubes.
Figure 17:
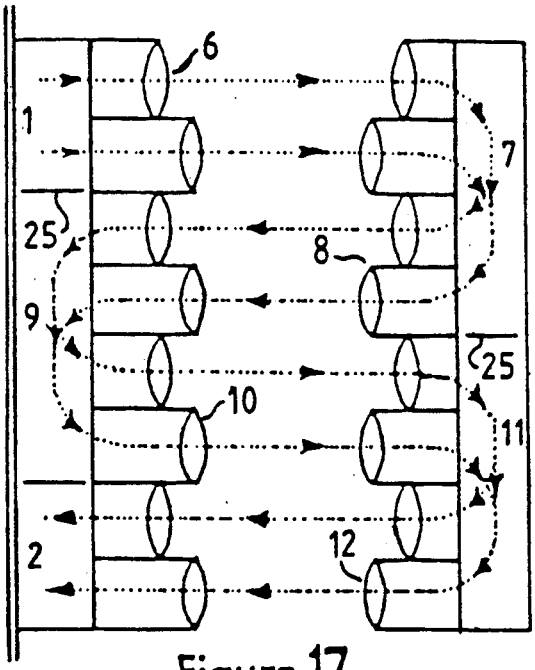
Figure 18:
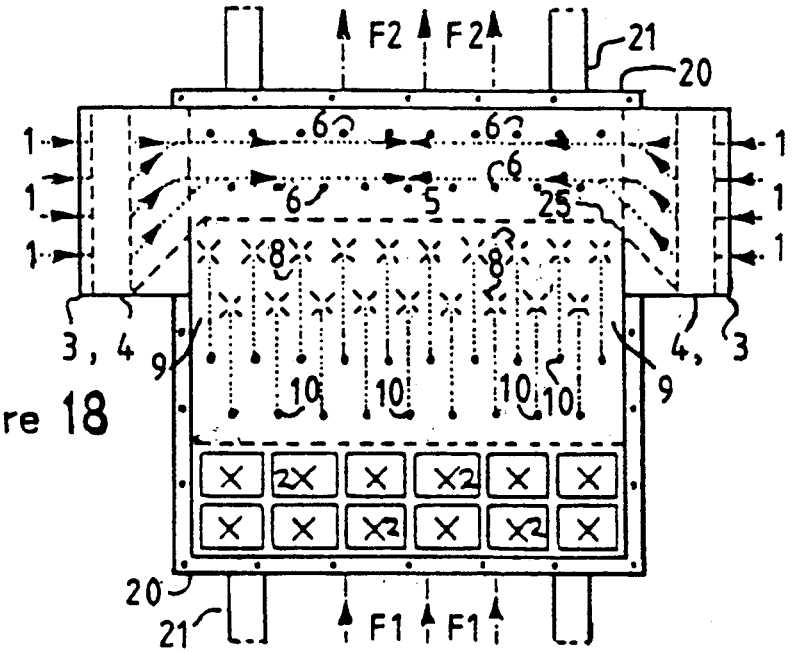
FIG. 18 is a schematic elevational view illustrating a fourth embodiment of the invention.

FIGS. 16 and 17 are further embodiments of the previously stated system whereby flue gases enter at F1 and exit at F2 through a greater number of tubes than depicted in FIG. 7, with room air entering at 1 and flowing through tubes 6 into and down communicating duct 7 and through tubes 8 and down communicating duct 9 and through tubes 10 and down communicating duct 11 and through tubes 12 and exiting into the room 2. FIG. 18 is a schematic elevation of FIGS. 16 and 17 with flue gases entering F1 and exiting F2 with room air entering at 1 and exiting at 2, for a possible installation to a chimney breast as depicted in FIG. 6 with a plan view of the containment depicted in FIG. 20, as 19, having flange 20 for bolting the unit in a gas proof seal, with the unit taking heat from the gases in a standard wall flue 21. Further adaptations of this unit are as previously stated—into an airing cupboard and/or another room and etc.

FIG. 19 is a schematic cross section of a possible system to a boiler or cooker or free standing heater as depicted in FIGS. 4 and 5 with further banks of tubes in addition to these previously stated,—through tubes 12—and down communicating duct 13 and through tubes 14 and down communicating duct 15 and through tubes 16 and exiting into the room 2. The containment here is an open sided box 17 with flange 20 for a gas proof seal and flue connector 18 at either end of the box for connection to after flue pipe of the heat source.

A further adaptation may be as in FIG. 1 where the fans housings 22 may be fitted at the bottoms of legs—as communicating ducts, vertically to and with duct 5, immediately in front of 23—and thereby allowing the open fire to be increased in size forward of its original surround 23 and with a larger grate fitted forward of the original at 24. The unit is removable from its containment structure thereby providing accessibility for the cleaning of the flue and also the unit itself which may be immersed, e.g. in a bath of liquids capable of dissolving any solid matter adhering to the unit. The unit could be constructed of materials such as stainless steel for appearance and freedom of maintenance and, e.g. zinc galvanized or electroplated steel tubes etc, and which unit by its removability may be maintained by redipping etc, if required.

Central heating is generally represented by radiators supplied with hot water from a boiler system through pipes, and over which radiators—should be referred to as convectors as radiation does not take place without a 200 deg C temperature difference between the radiator and the radiated—flows room air convecting away the heat to room furniture and etc, and generally raising room temperature.

With the unit fitted to an ordinary open fire, central heating is achieved without the cost and space of an installation of boiler, pipes or radiators. Air flowing through the unit at temperatures well in excess of 100 degC from a fan rated at about 100 CFM (cubic feet per minute) will be taken through or under doors, through Building Regulation required room ventilators and/or by other means—depicted—to all parts of a standard sized home, and in a short space of time drastically improve the temperature of that home.

e.g. providing forced air convection from an open fire with 100 CFM air at 100 deg C. to a 1200 sq ft home with an 8 ft stud height could increase the average air temperature to 25 deg C. (77 deg F.) from 0 deg C. in $$\frac{1}{\frac{100\text{ deg C.}}{25\text{ deg C.}} \times \frac{100\text{ CF per Min}}{1200 \times 8\text{ CF}} \times 60\text{ Min/Hr}}$$

Given no losses. = 0.4 Hrs./24 Mins.

The cost of running a 100 CFM fan is 1 unit of electricity (6.38 pence) per 40 Hrs, with a life expectancy of the fan between 25,000-30,000 Hrs (1250 days) continuous running.

The apparatus as hereinbefore described provides filtered particle free air and heated (depending on the fire built up) to temperatures well in excess of 100 deg C, which intensely heated air within the unit provides a bacterium and virus destruct—the vast majority of these being destroyed at 121 deg C—environment, further benefiting the interior environment of the home or workplace in providing all around warmth from an open fire—whereas without the apparatus a person would be warm on the side facing the fire and on the other side, and in providing a de-humidified (condensation loss), and well ventilated atmosphere.

Testing a unit of four banks of parallel spaced tubes in an open fire of dimensions 24 inches wide by 18 inches deep and using one fan of 100 CFM rating gave the following results in output:

| Test | Output | Efficiency |
|---|---|---|
| 1, | 220 deg C. | 78% |
| 2, | 66 deg C. | 83% |
| 3, | 102 deg C. | 83% |
| 4, | 185 deg C. | 84% |
| 5, | 104 deg C. | 82% |

The unit generally performed in the region of 80% efficiency, with the slight discrepancies in the test results being due to the fluctuation of flame strength resulting from the burning of wood only, for the results obtained in all tests.

Further tests were performed for actual output readings, and with Test 6 of the unit fitted into the top of an open fire of average burn; actual output from the unit registered 538,000 BTU.

During testing it was recorded that temperature some 40 feet distance from the unit, and seperated from the open fire by partitions, reached 0.8 deg C. higher than at positions 4 feet either side of the unit. It was also recorded that during all tests the unit remained cool to the touch, with Test 4 recording only 32 deg C. on top of the unit.

I claim:

1. Heating apparatus for heating an environment comprising:

a container means having inlet and outlet means and defining a flow path for heated fluid;

a plurality of heat exchange tubes disposed in said container means substantially transversely to said flow path and in spaced relationship in the direction of flow of said flow path, said tubes forming at least a part of at least one heat exchange conduit means for the flow of secondary fluid to be heated therethrough and having an inlet and an outlet; and fluid flow inducing means operatively connected to said at least one conduit means for inducing a flow of secondary fluid therethrough from said inlet to said outlet thereof;

said tubes being spaced so that the spacing between adjacent tubes gradually decreases in the direction of downstream flow of said heated fluid in said flow path so that the flow of secondary fluid through said tubes is balanced and said heated fluid is progressively compressed between said inlet and outlet means of said container means and the temperature of said heated fluid is increased in said downstream direction for improving the rate of heat exchange between said heated fluid and secondary fluid.

2. Apparatus as claimed in claim 1, wherein said at least one conduit means is adapted to pass substantially transversely to the flow of said flowpath at least twice.

3. Apparatus as claimed in claim 2, wherein a plurality of said conduit means are provided, each conduit means comprising at least one first bank of substantially parallel tubes extending into said flowpath, inlets for said first tubes operatively connected to said air-flow inducing means, outlets for said first tubes, and at least one second bank of substantially parallel tubes connected to said outlets for said first tubes and extending out of said flowpath.

4. Apparatus as claimed in claim 3, wherein each said conduit means comprises a single first bank of tubes and a single second bank of tubes.

5. Apparatus as claimed in claim 3, wherein each said conduit means comprised two first banks of tubes and two second banks of tubes.

6. Apparatus as claimed in claim 3, wherein each said conduit means comprises three first banks of tubes and three second banks of tubes.

7. Apparatus as claimed in claim 1, wherein each conduit means comprises a plurality of parallel tubes connected to form a sinuous flow path for air.

8. Apparatus as claimed in claim 7, wherein said tubes of each conduit means are arranged so that the direction of flow of air in each conduit means changes twice.

9. Apparatus as claimed in claim 1, wherein each heat exchange conduit means is in the form of a continuous tubular conduit.

10. Apparatus as claimed in claim 1, wherein each conduit means comprises a series of tubes connected by at least one plenum chamber.

11. Apparatus as claimed in claim 1, wherein the wall thickness of the tubes of each heat exchange conduit is less in a downstream part thereof with respect to said flowpath than the wall thickness of the tubes in an upstream part thereof.

12. Apparatus as claimed in claim 1, wherein said fluid flow inducing means comprises a compressor means.

13. Apparatus as claimed in claim 1, wherein said fluid flow inducing means includes a filter for filtering fluid entering the apparatus.

14. Apparatus as claimed in claim 1, wherein said inlet and outlet for said conduit means communicate with a room environment for drawing and heating air from said environment and returning heated air to said environment.

15. Apparatus as claimed in claim 1 wherein said inlet for said conduit means communicates with one environment for drawing air therefrom to be heated, and said outlet for said conduit means communicates with another environment for delivering heated air thereto.

16. Apparatus as claimed in claim 1 and further comprising a housing member for containing said heat exchange conduit means and said fluid flow inducing means.

* * * * *